US010991316B2

(12) United States Patent
Kim et al.

(10) Patent No.: US 10,991,316 B2
(45) Date of Patent: Apr. 27, 2021

(54) DISPLAY DEVICE AND DRIVING METHOD THEREOF

(71) Applicant: Samsung Display Co., Ltd., Yongin-si (KR)

(72) Inventors: Ji-Won Kim, Hwaseong-si (KR); Nam-Hee Goo, Hwaseong-si (KR); Byung-Su Oh, Hwaseong-si (KR); A Ra Jo, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/421,475

(22) Filed: May 24, 2019

(65) Prior Publication Data

US 2020/0143749 A1 May 7, 2020

(30) Foreign Application Priority Data

Nov. 6, 2018 (KR) ..... 10-2018-0135403

(51) Int. Cl.
*G09G 3/3275* (2016.01)
*G09G 3/20* (2006.01)

(52) U.S. Cl.
CPC ..... *G09G 3/3275* (2013.01); *G09G 3/2018* (2013.01); *G09G 2310/027* (2013.01); *G09G 2320/0257* (2013.01)

(58) Field of Classification Search
CPC ..... G09G 3/3275; G09G 3/2018; G09G 2310/027; G09G 2320/0257
See application file for complete search history.

(56) References Cited

U.S. PATENT DOCUMENTS

| | | | | |
|---|---|---|---|---|
| 7,358,947 | B2 | 4/2008 | Lee et al. | |
| 9,626,893 | B2 | 4/2017 | Kim et al. | |
| 10,115,376 | B2 | 10/2018 | Yu et al. | |
| 2015/0035819 | A1* | 2/2015 | Kim | G09G 3/3618 345/213 |
| 2016/0042687 | A1* | 2/2016 | Jeong | G09G 3/3233 345/690 |
| 2017/0162127 | A1 | 6/2017 | Park et al. | |
| 2017/0186357 | A1* | 6/2017 | Zeng | G09G 3/2018 |
| 2018/0374426 | A1* | 12/2018 | Chen | G09G 5/10 |

FOREIGN PATENT DOCUMENTS

| | | |
|---|---|---|
| KR | 10-0915234 | 8/2009 |
| KR | 10-2015-0007057 | 1/2015 |
| KR | 10-2017-0021427 | 2/2017 |
| KR | 10-1720345 | 3/2017 |

* cited by examiner

*Primary Examiner* — Amit Chatly
(74) *Attorney, Agent, or Firm* — H.C. Park & Associates, PLC

(57) ABSTRACT

A display device includes: a display panel to display an image; a signal controller to determine whether an input image signal is a still image signal, and if the input image signal is a still image signal, further determine whether image switching occurs, and if image switching occurs, to compensate image data according to frame data after the image is switched by using data values of two pieces of frame data between which the image switching occurs; and a data driver to generate a data signal based on the image data and to output the data signal to the display panel.

20 Claims, 12 Drawing Sheets

FIG. 11

| | BTG | | | | | |
|---|---|---|---|---|---|---|
| | BTG1 | | | BTG2 | | |
| second | Gray | Vdata (V) | current (pA) | Gray | Vdata (V) | current (pA) |
| 0.1 | 48 | 5.35 | 377 | 43 | 5.4 | 312 |
| 1 | 48 | 5.35 | 343 | 44 | 5.39 | 298 |
| 2 | 48 | 5.35 | 333 | 45 | 5.38 | 297 |
| 3 | 48 | 5.35 | 327 | 45 | 5.38 | 292 |
| 4 | 48 | 5.35 | 323 | 45 | 5.38 | 289 |
| 5 | 48 | 5.35 | 320 | 45 | 5.38 | 286 |
| 6 | 48 | 5.35 | 317 | 45 | 5.38 | 284 |
| 7 | 48 | 5.35 | 315 | 46 | 5.37 | 294 |
| 8 | 48 | 5.35 | 313 | 46 | 5.37 | 292 |
| 9 | 48 | 5.35 | 311 | 46 | 5.37 | 290 |
| 10 | 48 | 5.35 | 310 | 46 | 5.37 | 289 |
| 11 | 48 | 5.35 | 309 | 47 | 5.36 | 300 |
| 12 | 48 | 5.35 | 307 | 47 | 5.36 | 299 |
| 13 | 48 | 5.35 | 306 | 47 | 5.36 | 298 |
| 14 | 48 | 5.35 | 305 | 47 | 5.36 | 297 |
| 15 | 48 | 5.35 | 304 | 48 | 5.35 | 304 |
| 16 | 48 | 5.35 | 303 | 48 | 5.35 | 303 |
| 17 | 48 | 5.35 | 302 | 48 | 5.35 | 302 |
| 18 | 48 | 5.35 | 301 | 48 | 5.35 | 301 |
| 19 | 48 | 5.35 | 301 | 48 | 5.35 | 301 |
| 20 | 48 | 5.35 | 301 | 48 | 5.35 | 301 |

(a)

| | WTG | | | | | |
|---|---|---|---|---|---|---|
| | WTG1 | | | WTG2 | | |
| second | Gray | Vdata (V) | current (pA) | Gray | Vdata (V) | current (pA) |
| 0.1 | 48 | 5.35 | 239 | 51 | 5.31 | 272 |
| 1 | 48 | 5.35 | 257 | 49 | 5.33 | 274 |
| 2 | 48 | 5.35 | 263 | 49 | 5.34 | 278 |
| 3 | 48 | 5.35 | 266 | 48 | 5.35 | 267 |
| 4 | 48 | 5.35 | 268 | 48 | 5.35 | 268 |
| 5 | 48 | 5.35 | 270 | 48 | 5.35 | 270 |
| 6 | 48 | 5.35 | 271 | 48 | 5.35 | 271 |
| 7 | 48 | 5.35 | 273 | 48 | 5.35 | 273 |
| 8 | 48 | 5.35 | 274 | 48 | 5.35 | 274 |
| 9 | 48 | 5.35 | 275 | 48 | 5.35 | 275 |
| 10 | 48 | 5.35 | 275 | 48 | 5.35 | 275 |
| 11 | 48 | 5.35 | 276 | 48 | 5.35 | 276 |
| 12 | 48 | 5.35 | 277 | 48 | 5.35 | 277 |
| 13 | 48 | 5.35 | 277 | 48 | 5.35 | 277 |
| 14 | 48 | 5.35 | 278 | 48 | 5.35 | 278 |
| 15 | 48 | 5.35 | 279 | 48 | 5.35 | 279 |
| 16 | 48 | 5.35 | 279 | 48 | 5.35 | 279 |
| 17 | 48 | 5.35 | 280 | 48 | 5.35 | 280 |
| 18 | 48 | 5.35 | 280 | 48 | 5.35 | 280 |
| 19 | 48 | 5.35 | 280 | 48 | 5.35 | 280 |
| 20 | 48 | 5.35 | 280 | 48 | 5.35 | 280 |

(b)

FIG. 13

| | | K-1 | | | | | | | | | | | | | | | | |
|---|---|---|---|---|---|---|---|---|---|---|---|---|---|---|---|---|---|---|
| | GRAY | 0 | 16 | 32 | 48 | 64 | 80 | 96 | 112 | 128 | 144 | 160 | 176 | 192 | 208 | 224 | 240 | 255 |
| K | 0 | | 2 | 3 | 5 | ··· | | | | | | | | | | | | |
| | 16 | 14 | | 18 | 19 | ··· | | | | | | | | | | | | |
| | 32 | 29 | 30 | | 34 | ··· | | | | | | | | | | | | |
| | 48 | 45 | 46 | 47 | | ··· | | | | | | | | | | | | |
| | 64 | ··· | ··· | ··· | ··· | | | | | | | | | | | | | |
| | 80 | | | | | | | | | | | | | | | | | |
| | 96 | | | | | | | | | | | | | | | | | |
| | 112 | | | | | | | | | | | | | | | | | |
| | 128 | | | | | | | | | | | | | | | | | |
| | 144 | | | | | | | | | | | | | | | | | |
| | 160 | | | | | | | | | | | | | | | | | |
| | 176 | | | | | | | | | | | | | | | | | |
| | 192 | | | | | | | | | | | | | | | | | |
| | 208 | | | | | | | | | | | | | | | | | |
| | 224 | | | | | | | | | | | | | | | | | |
| | 240 | | | | | | | | | | | | | | | | | |
| | 255 | | | | | | | | | | | | | | | | | |

DISPLAY DEVICE AND DRIVING METHOD THEREOF

CROSS-REFERENCE TO RELATED APPLICATION

This application claims priority from and the benefit of Korean Patent Application No. 10-2018-0135403, filed on Nov. 6, 2018, which is hereby incorporated by reference for all purposes as if fully set forth herein.

BACKGROUND

Field

Exemplary implementations of the invention relate generally to a display device and a driving method thereof and, more particularly, to a display device and driving method capable of reducing sticking of still images.

Discussion of the Background

Through a display of a mobile device, a user can view images or use visual content such as games, photo viewing, and editing. As the mobile device market is continuously expanding, demand for high-resolution displays is growing.

In the case of a high-resolution display, a large number of pixels are located within a small area. Further, in order to reduce a characteristic deviation of each of the pixels, each pixel includes several transistors. Thus, an area occupied by transistors included in one pixel is also small.

A hysteresis occurs in which values of a drain current flowing through the transistor have different values according to methods of applying a gate voltage to such a transistor. The hysteresis makes it difficult for a current value through a driving transistor of the pixel to reach a target current value, resulting in an image sticking on a display when an image that is being displayed is switched to another image.

The above information disclosed in this Background section is only for understanding of the background of the inventive concepts, and, therefore, it may contain information that does not constitute prior art.

SUMMARY

Devices and methods constructed according to exemplary implementations of the invention suppress image sticking at the time of image switching.

Devices and methods constructed according to exemplary implementations of the invention also provide an improvement of display quality of a display device.

Additional features of the inventive concepts will be set forth in the description which follows, and in part will be apparent from the description, or may be learned by practice of the inventive concepts.

According to an exemplary embodiment, a display device may include: a display panel to display an image; a signal controller to determine whether an input image signal is a still image signal, and if the input image signal is a still image signal, to further determine whether image switching occurs, and if image switching occurs, to compensate image data according to frame data after the image is switched by using data values of two pieces of frame data between which the image switching occurs; and a data driver to generate a data signal based on the image data and to output the data signal to the display panel.

The signal controller may include an image determiner to compare at least two pieces of frame data of the input image signal that are adjacent to each other, to determine whether the input image signal is a still image signal.

The image determiner could receive a panel self-refresh (PSR) control signal to control a PSR mode for displaying a still image with the input image signal, and to determine whether the input image signal is a still image signal based on the PSR control signal.

If the image determiner determines that the input image signal is a still image signal, the image determiner could compare at least two pieces of frame data of the input image signal that are adjacent to each other, to determine whether image switching occurs.

If the image determiner determines that image switching occurs, an image compensator of the signal controller could compensate image data according to the frame data after the image is switched, and a data signal could be applied to any pixel included in the display panel corresponding to a different gray from a target gray based on the frame data after the image is switched.

The image compensator may could compensate the image data for a plurality of frame periods after the image is switched.

The image compensator could compensate the image data according to the frame data after the image is switched during a plurality of frame periods after the image is switched, so that a data signal applied to the pixel corresponds to a plurality of grays different from a target gray based on the frame data after the image is switched.

The image compensator could set a plurality of grays to be adjacent to the target gray over time after the image is switched.

According to another exemplary embodiment, a display device may include: a display panel including a pixel including a light emitting element to emit light based upon a driving current corresponding to a data signal being applied to a data line; a signal controller to generate image data according to an input image signal; and a data driver to generate a data signal by using the input image signal, wherein voltage values of data signals applied to the pixel corresponding to the same gray are different from each other, based on whether a still image displayed by the input image signal is switched.

The voltage value of a data signal applied to the pixel may increase or decrease from a time point when the still image is switched.

A period in which the voltage value of the data signal applied to the pixel increases or decreases may be within 15 seconds.

The pixel may further include: a first transistor to conduct driving current according to a voltage difference between a gate and one end of the first transistor; a capacitor to store a voltage corresponding to the data signal; and a second transistor connected to a data line and to be activated by a corresponding scan signal to receive the data signal, wherein voltage values of data signals applied to the pixel corresponding to the same gray are different from voltage values of data signals applied to the pixel according to whether a still image displayed by the input image signal is switched.

According to an exemplary embodiment, a driving method of a display device may include the steps of: determining whether an input image signal is a still image signal; if the input image signal is a still image signal, further determining whether image switching occurs; and if image switching occurs, using data values of two pieces of frame data between which the image is switched to compensate image data according to frame data after the image is switched.

The step of further determining whether the image switching occurs may include comparing at least two pieces of frame data of the input image signal that are adjacent to each other, to determine whether the input image signal is a still image signal.

The step of further determining whether the image switching occurs may further include receiving a PSR control signal for controlling a PSR mode to display a still image with the input image signal, and determining whether the input image signal is a still image signal based on the PSR control signal.

The step of further determining whether the image switching occurs may further include determining that the input image signal is a still image signal, and then comparing at least two adjacent pieces of frame data of the input image signal to each other and determining whether image switching occurs.

The step of compensating of the image data may include, if image switching occurs, compensating the image data according to the frame data after image switching occurs, and applying a data signal to any pixel included in a display panel corresponding to a different gray from a target gray based on the frame data after image switching occurs.

The step of compensating the image data may further comprise compensating the image data for a plurality of frame periods after image switching occurs.

The step of compensating the image data for a plurality of frame periods after image switching occurs may include compensating the image data according to the frame data after image switching occurs for a plurality of frame periods after image switching occurs, and compensating a data signal applied to any pixel included in the display panel corresponding to a different gray from a target gray based on the frame data after image switching occurs.

A plurality of grays may be set to be close in value to the target gray over time after the image switching occurs.

According to exemplary embodiments, image sticking due to displayed images can be reduced.

According to exemplary embodiments, the display quality of a display device can be improved.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

FIG. 11 and FIG. 12 are tables and graphs showing a current flowing through an organic light emitting diode, and FIG. 13 is a lookup table (LUT) according to an exemplary driving method of a display device according to exemplary embodiments.

DETAILED DESCRIPTION

Figure 1:
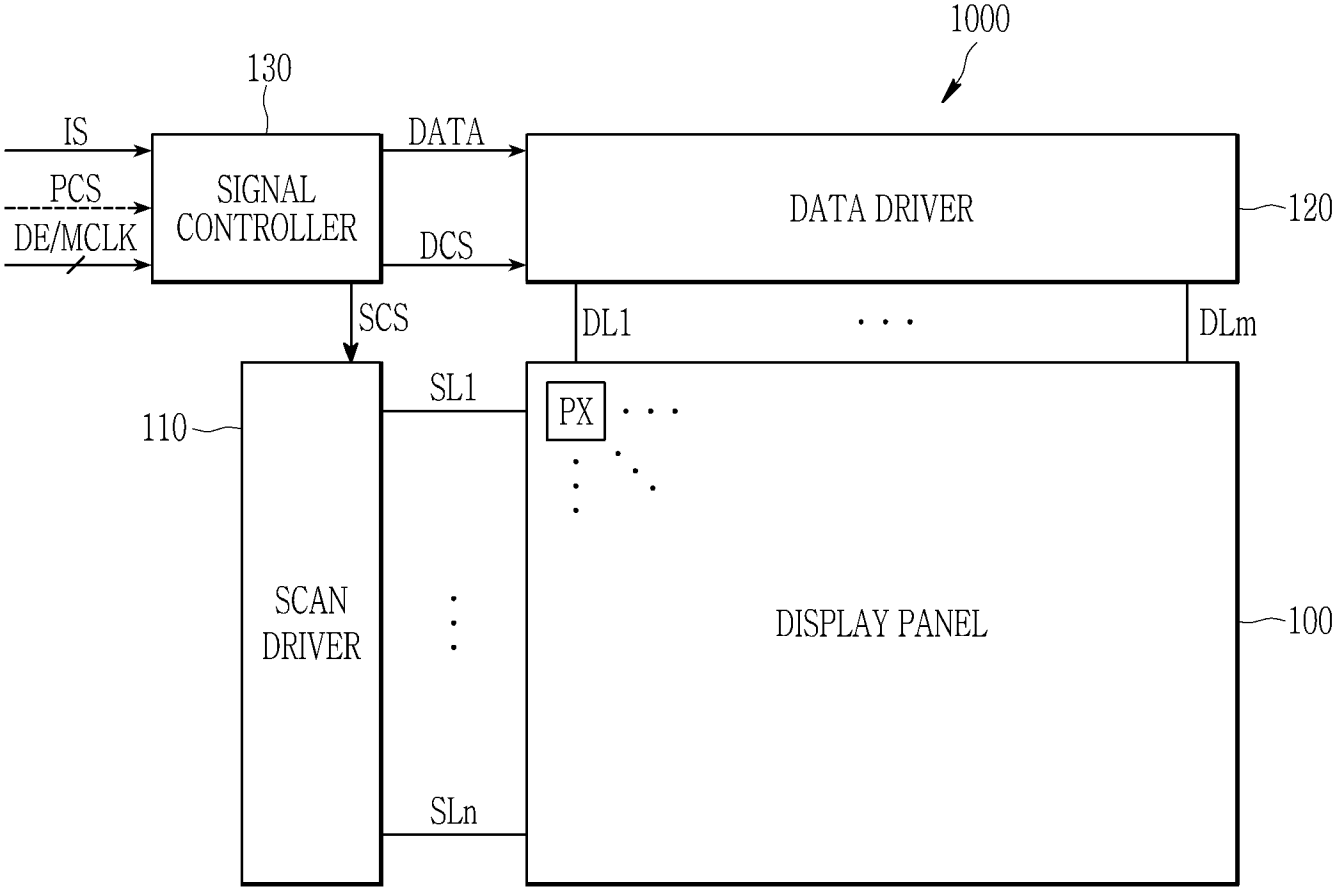
FIG. 1 is a block diagram showing a display device constructed according to an exemplary embodiment of the invention.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram showing a display device constructed according to an exemplary embodiment.

Referring to FIG. 1, a display device 1000 may include a display panel 100, a scan driver 110, a data driver 120, and a signal controller 130.

The display device 1000 may include an organic light emitting device, a liquid crystal display, and the like. Further, the display device 1000 may be a flexible display device, a rollable display device, a curved display device, a transparent display device, and a mirror display device, which are implemented by the organic light emitting device.

The display panel 100 may include a plurality of pixels PX and may display an image. Specifically, the display panel 100 may include a plurality of pixels PX each connected to a corresponding one of a plurality of scan lines SL1 to SLn and a corresponding one of a plurality of data lines DL1 to DLm.

The scan driver 110 may provide a scan signal to the pixels PX of the display panel 100 through the scan lines SL1 to SLn. The scan driver 110 may provide the scan signal to the display panel 100 based on a first control signal SCS received from the signal controller 130.

The data driver 120 may provide a data signal corresponding to image data DATA to the pixels PX of the display panel 100 through the data lines DL1 to DLm. The data driver 120 may provide the data signal to the display panel 100 based on a second control signal DCS received from the signal controller 130. In an exemplary embodiment, the data driver 120 may include a gamma correction unit (or a gamma voltage generator) for converting the image data DATA into a voltage corresponding to the data signal. The image data DATA of a gray domain may be converted into a data voltage of a voltage domain by the gamma correction unit.

The signal controller 130 may receive control signals such as an input image signal IS, a data enable signal DE, and a main clock signal MCLK. In addition, when the display device 1000 is interfaced with an external graphics source through an eDP (embedded display port) v1.3 or the like, the display device 1000 may receive a PSR control signal PSC for panel self-refresh (hereinafter referred to as 'PSR')

A PSR command signal may include a PSR start signal for starting a PSR mode, a PSR end signal for ending the PSR mode and a re-synchronization end signal for ending the re-synchronization mode set for a predetermined interval immediately after the end of the PSR mode.

The signal controller 130 may control driving of the scan driver 110 and the data driver 120. The signal controller 130 may generate the first and second control signals SCS and DCS, and provide the first and second control signals SCS and DCS to the scan driver 110 and the data driver 120 so that the scan driver 110 and the data driver 120 can be controlled. Also, the signal controller 130 may drive the display device 1000 in a normal mode or a PSR mode based on the PSR control signal PCS.

Figure 2:
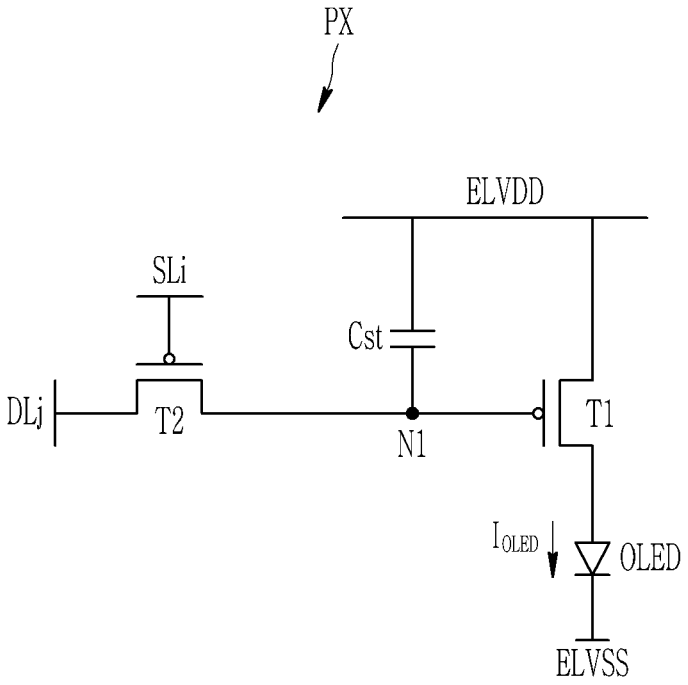
FIG. 2 is a circuit diagram showing a representative pixel of the display device of FIG. 1.

FIG. 2 is a circuit diagram showing a pixel of the display device of FIG. 1 constructed according to an exemplary embodiment.

As shown in FIG. 2, a pixel PX may include a first transistor T1, a second transistor T2, a storage capacitor Cst, and an organic light emitting diode OLED. The pixel PX may be located in the i-th pixel row and the j-th pixel column.

The first transistor T1 may be a driving transistor. In an exemplary embodiment, the first transistor T1 may include a gate connected to a first node N1, one end connected to a first power supply voltage ELVDD, and the other end connected to an anode of the organic light emitting diode OLED.

A driving current $I_{OLED}$ is a current corresponding to a voltage difference between the gate and one end of the first transistor T1, and may be varied corresponding to a data voltage according to a data signal applied through a data line DLj.

A second transistor T2 may transmit a data signal to the first node N1 according to a level of the i-th scan signal S[i]. In an exemplary embodiment, the second transistor T2 may include a gate connected to an i-th scan line SLi, one end connected to a data line DLj, and the other end connected to the first node N1.

The storage capacitor Cst is connected between the first power supply voltage ELVDD and the first node N1. In an exemplary embodiment, the storage capacitor Cst may include one end connected to the first power supply voltage ELVDD and the other end connected to the first node N1.

The organic light emitting diode OLED may emit light by the driving current IDLED flowing from the first transistor T1. In an exemplary embodiment, the organic light emitting diode OLED may include an anode connected to the other end of the first transistor T1 and a cathode connected a second power supply voltage ELVSS.

Figure 3:
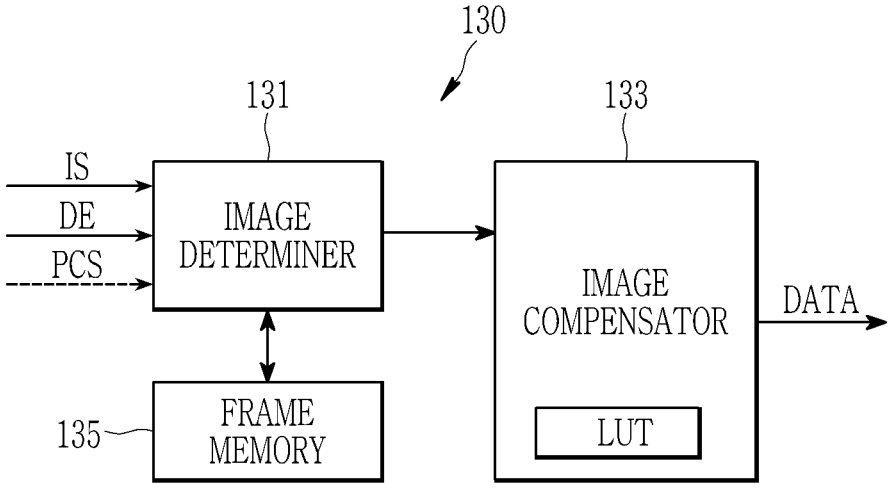
FIG. 3 is a block diagram showing an exemplary embodiment of a signal controller of the display device of FIG. 1.

FIG. 3 is a block diagram showing a signal controller of a display device of FIG. 1.

As shown in FIG. 3, the signal controller 130 may include an image determiner 131, an image compensator 133, and a frame memory 135.

The image determiner 131 may receive an input image signal IS, and may determine whether the input image signal IS reflects a still image or a moving image. In an exemplary embodiment, the image determiner 131 may compare at least two pieces of frame data of the input image signal IS to determine whether the input image signal IS is a still image signal or a moving image signal. Herein, the at least two pieces of frame data may be adjacent to each other.

Figure 4:
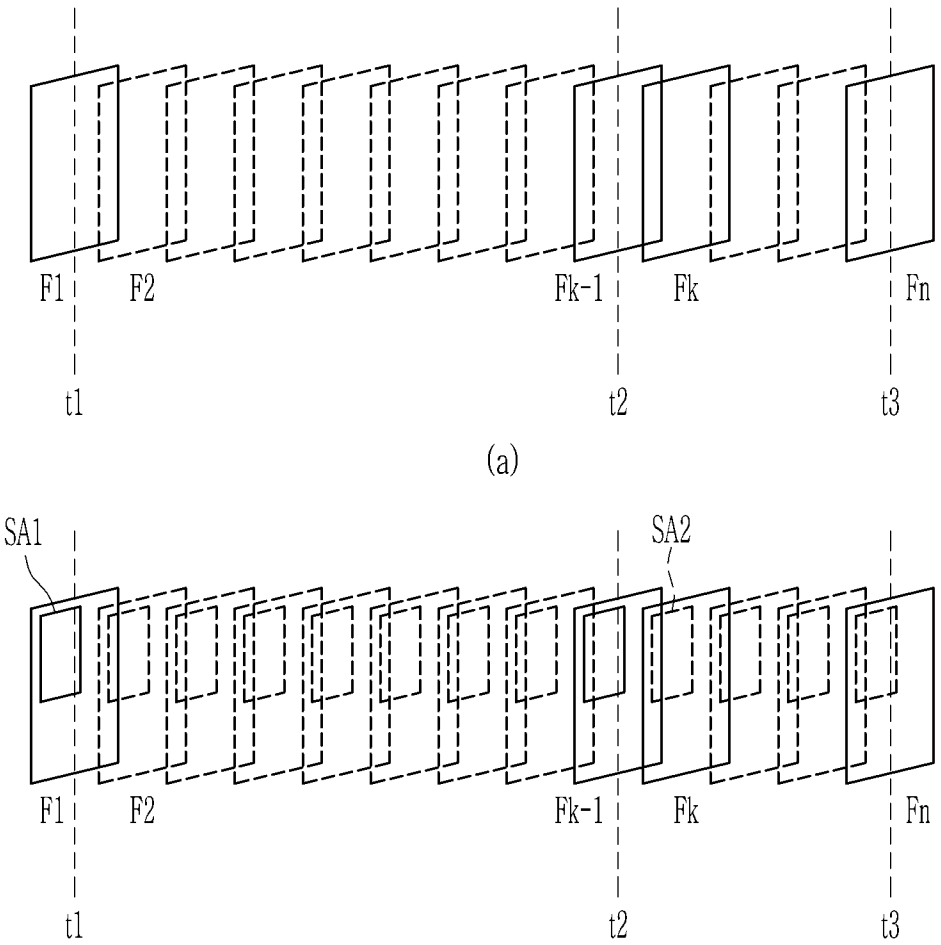
FIG. 4 is a drawing of an example in which a display device switches an image according to an exemplary embodiment of the invention.

For example, the image determiner 131 may compare the at least two pieces of frame data adjacent to each other among pieces of frame data (e.g., F1 to Fk in (a) of FIG. 4). Specifically, the image determiner 131 may compare the first and second pieces of frame data F1 and F2. The image determiner 131 may compare first data values included in the first frame data (e.g., the first data value of a specific location) and second data values included in the second frame data (e.g., a second data value of the specific location), and if the difference (or magnitude of the difference) between the first data values and the second data values is less than a predetermined reference value, the image determiner 131 may determine that the input image signal IS is a still image signal, and if the difference between the first data values and the second data values exceeds a predetermined reference value, the image determiner 131 may determine that the input image signal IS is a moving image signal.

As another example, the image determiner 131 may compare data values of a partial area SA1 in at least two pieces of frame data adjacent to each other among pieces of frame data (e.g., F1 to Fk in (b) of FIG. 4). For example, the image determiner 131 may compare data values of a partial area SA1 in the first and second pieces of frame data F1 and F2. Specifically, the determiner 131 may compare first data values corresponding to the area SA1 in the first frame data and second data values corresponding to the area SA1 in the second frame data, and if the difference (or magnitude of the difference) between the first data values and the second data values is less than a predetermined reference value, the image determiner 131 may determine that the input image signal IS is a still image signal, and if the difference between the first data values and the second data values exceeds a predetermined reference value, the image determiner 131 may determine that the input image signal IS is a moving image signal.

When the image determiner 131 receives a PSR control signal PCS, the image determiner 131 may determine that a PSR mode period is started based on a PSR start signal included in the PSR control signal PCS, and the image determiner 131 may determine that the input image signal IS received from an external graphics source is a still image signal. When the image determiner 131 receives the PSR start signal, the image determiner 131 may store received frame data of the input image signal IS to the frame memory 135.

If the input image signal IS is a still image or has a still image region, the image determiner 131 may determine whether image switching occurs in the input image signal IS. For example, the image determiner 131 may compare at least two pieces of frame data of the input image signal IS to determine whether image switching occurs, similar to a method of determining whether an image is a still image. If frame data is preliminarily stored in the frame memory 135 (i.e., when a PSR mode according to a PSR start signal is started), the image determiner 131 may compare frame data of the input signal IS and frame data stored in advance in the frame memory 135 and determine whether or not an image is switched.

Referring to FIG. 4, a method of switching images is described in detail.

FIG. 4 is a drawing of an example in which a display device switches an image according to an exemplary embodiment.

As shown in FIG. 4 (*a*), during a period from t1 to t2, the first still image is displayed on the display panel 100 by a plurality of pieces of frame data F1 to Fk−1. Frame data Fk after a time t2 is data for displaying a second still image different from the first still image.

For example, the image determiner 131 compares data values included in the frame data Fk−1 and data values included in the frame data Fk, and if the difference exceeds a predetermined reference value, the image determiner 131 may determine that the image is switched. That is, the image determiner 131 can determine whether the image is switched according to a result of comparing the frame data F1 to Fn included in the input image signal IS.

As another example, the image determiner 131 may compare data values included in frame data stored in the frame memory 135 and data values included in inputted frame data to determine whether the image is switched. For example, it is assumed that a PSR mode is started at time t1. The image determiner 131 stores frame data F1 received in the frame memory 135 at the start of the PSR mode. Further, when a data enable signal DE is received from an external graphics source, the image determiner 131 may compare the frame data Fk at that time and the frame data F1 stored in the frame memory 135 to determine whether or not an image is switched.

As shown in FIG. 4 (*b*), during a period from t1 to t2, the first still image SA1 is displayed on a partial area of the display panel 100 by a plurality of pieces of frame data F1 to Fk−1. A frame data Fk after a time t2 is data for displaying the second still image SA2 different from the first still image SA1 in a partial area of the display panel 100. The size of an area in which the first still image SA1 is displayed and the size of an area in which the second still image SA2 is displayed are not limited, and it is assumed that the two areas are equal to each other in the following description. An example of image switching in FIG. 4 (*b*) includes a case in which any pixel PX of the display panel 100 emits light controlled by a data signal for displaying the second still image SA2 after being controlled by the data signal to emit light for displaying the first still image SA1 during a period t1 to t2 (i.e., during a plurality of frame periods).

The image determiner 131 may compare data values for displaying the first still image SA1 among data values included in the frame data Fk−1 and data values for displaying the second still image SA2 among data values included in the frame data Fk, and if the difference exceeds a predetermined reference value, the image determiner 131 may determine that the image is switched. That is, the image determiner 131 can determine whether the image is switched according to a result of comparing the frame data F1 to Fn included in the input image signal IS.

The image determiner 131 may generate image data DATA from an input image signal IS and transmit to the image compensator 133. When the image determiner 131 determines that an image is switched, the image determiner 131 may output an image compensation control signal to the image compensator 133.

When the image compensation control signal is input to the image compensator 133, the image compensator 133 compensates transmitted image data DATA and outputs it to the data driver 120. When the image compensation control signal is not input to the image compensator 133, the image compensator 133 outputs the transmitted image data DATA to the data driver 120.

When image switching has occurred so that a pixel for displaying a first gray value actually displays a second gray value, the image compensator 133 may compensate image data DATA with an arbitrary gray value between the first gray and the second gray.

For example, when image switching has occurred so that a pixel for displaying a high gray displays a low gray, the image compensator 133 may compensate image data DATA with an arbitrary gray value between the high gray and the low gray. At that time, the larger the difference between the high gray and the low gray, the larger the arbitrary gray value may be. For example, when image switching has occurred so that a pixel for displaying the high gray 32 displays the low gray 0, the compensated gray level is 3, and when image switching has occurred so that a pixel for displaying the high gray 48 displays the low gray 0, the compensated gray level is 5.

As another example, when image switching occurs so that a pixel displaying a high gray displays a low gray, the image compensator 133 may compensate image data DATA with an arbitrary gray value between the high gray and the low gray. At that time, the larger the difference between the high gray and the low gray, the smaller an arbitrary gray value may be. For example, when image switching has occurred so that a pixel displaying the low gray 16 displays the high gray 48, the compensated gray level is 46, and when image switching has occurred so that a pixel displaying the low gray 32 displays the high gray 48, the compensated gray level is 47.

The image compensator 133 may include a predetermined compensation lookup table LUT according to physical characteristics of the display panel 100. The image compensator 133 may compensate image data DATA by referring to the compensation lookup table LUT. An example of a lookup table LUT is shown in FIG. 13.

If a gray value of a data signal inputted to a pixel PX in a K−1 frame is 32 and a gray value of a data signal inputted to the pixel PX in a K frame is 0, the image compensator 133 may compensate a gray value of a data signal inputted to the pixel PX by 3 (a value between 32 and 0).

If a gray value of a data signal inputted to a pixel PX in a K−1 frame is 32 and a gray value of a data signal inputted to the pixel PX in a K frame is 48, the image compensator 133 may compensate a gray value of a data signal inputted to the pixel PX by 47 (a value between 48 and 32).

Figure 5:
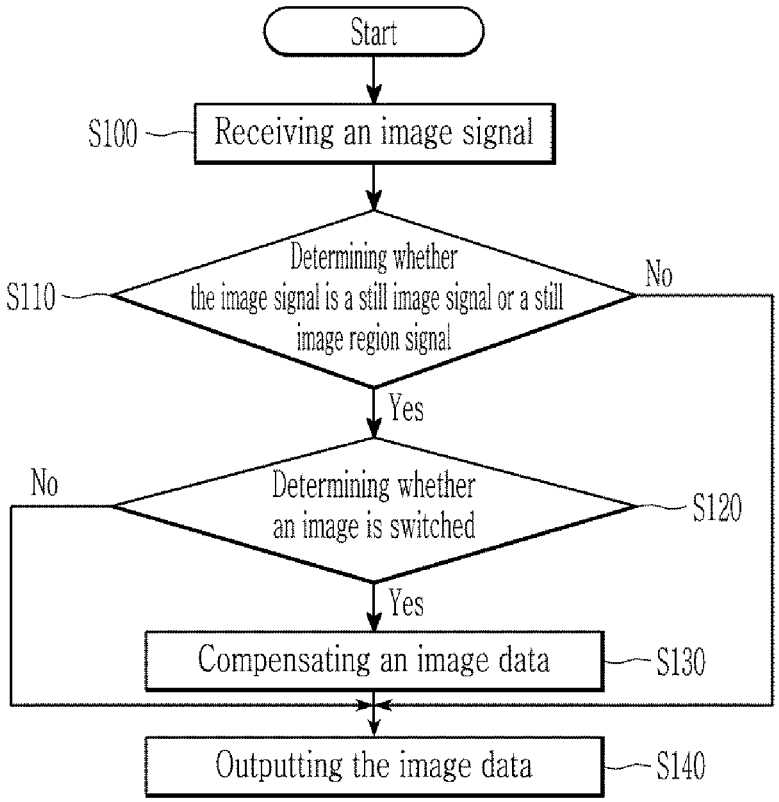
FIG. 5 is a flowchart of an exemplary driving method of a display device according to an exemplary embodiment.

Next, referring to FIG. 5, a method of driving a display device according to an exemplary embodiment is described in detail.

FIG. 5 is a flowchart of a driving method of a display device according to an exemplary embodiment. In FIG. 5, it is assumed that the signal controller 130 does not separately receive the PSR control signal.

The image determiner 131 of the signal controller 130 receives an input image signal IS (S100).

Next, the image determiner 131 determines whether the input image signal IS is a still image signal (SI 10).

If the input image signal IS is a still image signal, the image determiner 131 determines whether an image is switched in the input image signal IS (S120). If the image switching has occurred in the input image signal IS, the image determiner 131 may generate image data DATA using the input image signal IS, and output an image compensation control signal to the image compensator 133.

Then, the image compensator 133 compensates image data DATA after the image is switched (S130). At this time, the image compensator 133 may use image data DATA before the image is switched and image data DATA after the image is switched.

The image compensator 133 outputs compensated image data DATA to the data driver 120 (S140).

If it is determined in step S110 that the input image signal IS is not a still image signal or if it is determined in step S120 that no image switching occurs in the input image signal IS, the image determiner 131 generates image data DATA using in the input image signal IS, and outputs it to the data driver 120 (S140).

Figure 6:
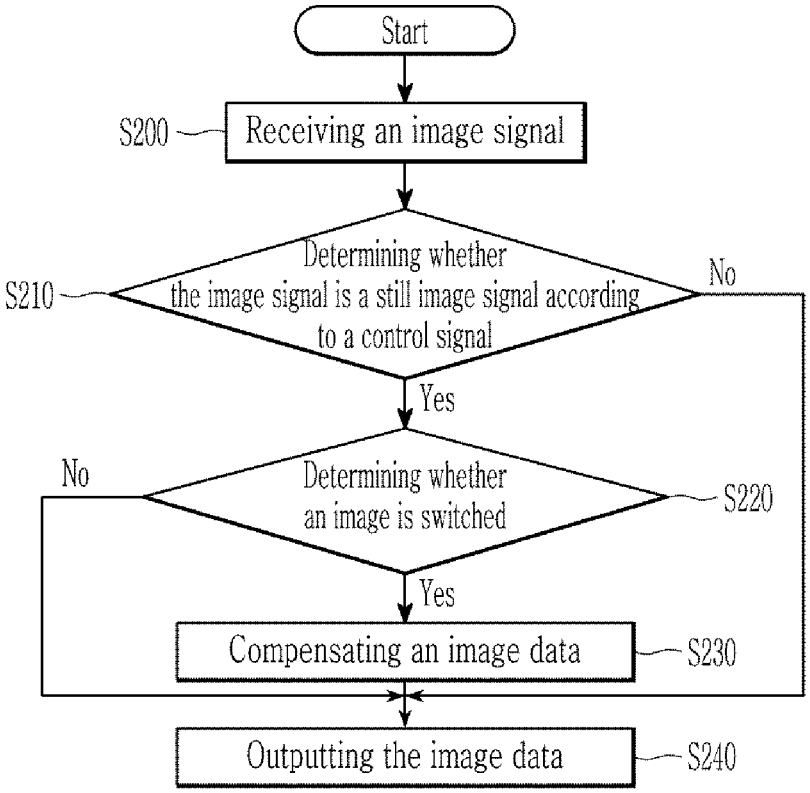
FIG. 6 is a flowchart of an exemplary driving method of a display device according to another exemplary embodiment.

Next, referring to FIG. 6, a method of driving a display device according to an exemplary embodiment is described in detail.

FIG. 6 is a flowchart of a driving method of a display device according to another exemplary embodiment. In FIG. 6, it is assumed that the signal controller 130 separately receives a PSR control signal.

The image determiner 131 of the signal controller 130 receives an input image signal IS (S200).

Next, the image determiner 131 determines whether the input image signal IS is a still image signal according to the PSR control signal PCS (S210).

If the input image signal IS is a still image signal, the image determiner 131 determines whether an image is switched in the input image signal IS (S220). If image switching has occurred in the input image signal IS, the image determiner 131 may generate image data DATA using the input image signal IS, and output an image compensation control signal to the image compensator 133.

Then, the image compensator 133 compensates image data DATA after the image is switched (S230). At this time, the image compensator 133 may use image data DATA before the image is switched and image data DATA after the image is switched.

The image compensator 133 outputs compensated image data DATA to the data driver 120 (S240).

If it is determined in step S210 that the input image signal IS is not a still image signal or if it is determined in step S220 that no image switching occurs in the input image signal IS, the image compensator 133 outputs image data DATA stored in the frame memory 135 to the data driver 120 (S240).

Next, referring to FIG. 7 to FIG. 10, a data signal applied to any pixel PX at the time of image switching is described.

FIGS. 7 to 10 are drawings showing data signals applied to pixels to which an image is switched according to a driving method of a display device according to exemplary embodiments.

In FIG. 7 to FIG. 10, the same data signal Vdata is applied to a pixel PX every frame during a display period of displaying a still image. However, when a still image starts to be displayed, in some frames, a data signal Vdata is not applied.

In FIG. 7 to FIG. 10, the image is switched, so that for displaying the second gray, the second voltage V2 is applied to a pixel PX which displayed the first gray by applying the first voltage V1 before image switching (the first gray<the second gray).

Figure 7:
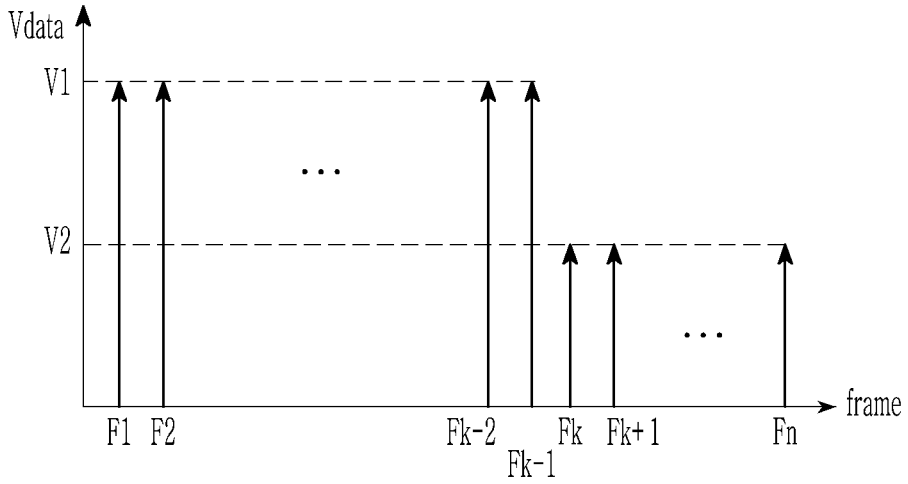
FIG. 7 to FIG. 10 are drawings showing data signals applied to pixels of which an image is switched according to an exemplary driving method of a display device according to exemplary embodiments.

As shown in FIG. 7, during a period of the first frame F1 to the (k−1)th frame Fk−1, a data signal Vdata applied to the pixel PX may be the first voltage V1. When image switching occurs in the k-th frame Fk, a data signal Vdata applied to the pixel PX may be the second voltage V2. The first voltage V1 is a voltage for displaying a low gray, the second voltage V2 is a voltage for displaying a high gray, and the first voltage V1 is higher than the second voltage V2. After the image is switched, a data signal Vdata of the second voltage V2 is applied to the pixel PX until the n-th frame Fn.

Figure 8:
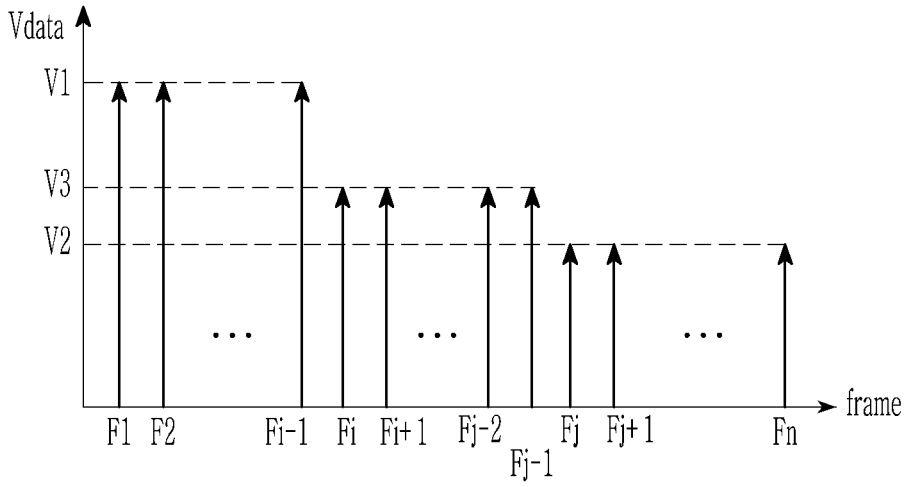

As shown in FIG. 8, during a period of the first frame F1 to the (i−1)th frame Fi−1, a data signal Vdata applied to the pixel PX may be the first voltage V1. When image switching occurs in the i-th frame Fi, the image compensator 133 may compensate image data DATA so that the data signal Vdata applied to the pixel PX has a voltage corresponding to a gray level between the first gray according to the first voltage V1 and the second gray according to the second voltage V2. A data signal Vdata applied to the pixel PX in the i-th frame Fi may be a third voltage V3. The third voltage V3 may be a voltage corresponding to an arbitrary gray between the first gray and the second gray.

A data signal Vdata of the third voltage V3 may be applied to the pixel PX during at least one period of frames Fi to Fj−1. A period of Fi to Fj−1 may be within 15 seconds, but is not limited thereto. The period of Fi to Fj−1 may have a larger value as difference between the first gray and second gray is larger, and is not limited herein.

When at least one period of frames Fi to Fj−1 elapses, a data signal Vdata of the second voltage V2 is applied to the pixel PX from the j-th frame Fj to the n-th frame Fn.

Figure 9:
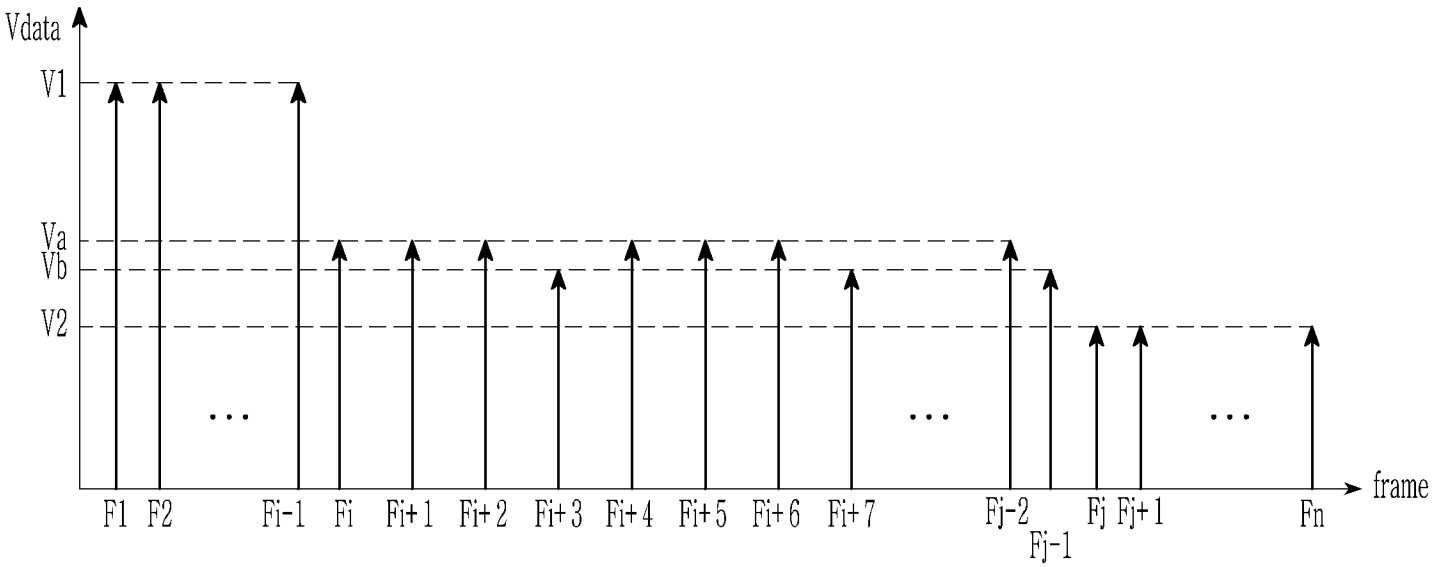

Also, as shown in FIG. 9, during a period of the first frame F1 to the (i−1)th frame Fi−1, a data signal Vdata applied to the pixel PX may be the first voltage V1. When image switching occurs in the i-th frame Fi, the image compensator 133 may compensate image data DATA so that the data signal Vdata applied to the pixel PX has a voltage corresponding to a gray level between the first gray and the second gray.

Specifically, the image compensator 133 may set an intermediate gray level between the first gray and the second gray to a decimal instead of an integer. In this case, a plurality of frames may be regarded as one unit, and some frames of the plurality of frames corresponding to one unit may be emitted as a first intermediate gray, and the remaining frames of the plurality of frames corresponding to one unit are emitted as a second intermediate gray. In FIG. 9, a data signal Vdata applied to the pixel PX in the i-th frame Fi to the (i+2)th frame Fi+2 among four frames corresponding to one unit (for example, Fi to Fi+2) may be the first intermediate voltage Va, and a data signal Vdata applied to the pixel PX in the (i+3)th frame Fi+3 may be the second intermediate voltage Vb. If a halftone is a decimal number (for example, 47.75) not an integer, four frames are repeated as one unit, and a data signal of the first intermediate voltage (corresponding to the 48 gray) may be applied to three frames among four frames, while a data signal of the second intermediate voltage (corresponding to the 47 gray) may be applied to the remaining one frame.

In the above, four frames as one unit are an example. A number of intermediate voltages also may be two or more, and an order of frames in which a second intermediate voltage Vb is applied among four frames is not limited.

Then, the four frames may be repeated until the j-th frame Fj at which a data signal Vdata of the second voltage V2 is applied.

Figure 10:
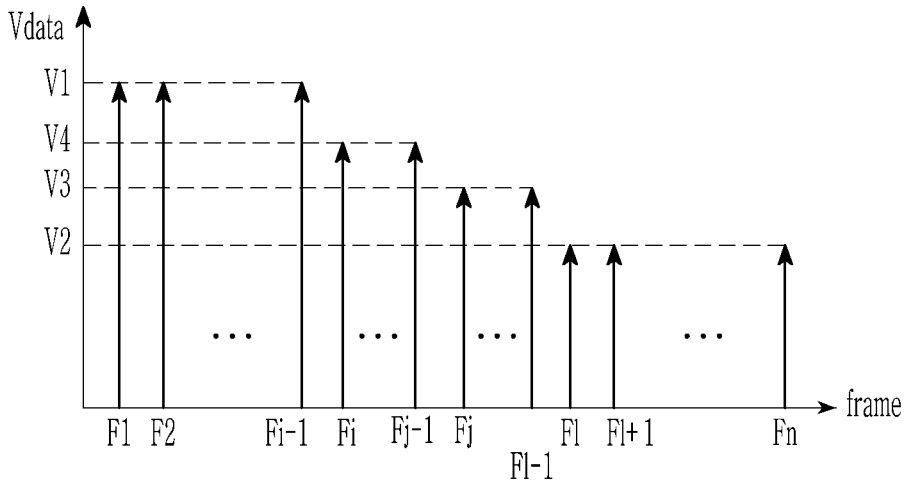

As shown in FIG. 10, during a period of the first frame F1 to the (i−1) th frame Fi−1, a data signal Vdata applied to the pixel PX may be the first voltage V1. When image switching occurs in the i-th frame Fi, the image compensator 133 may compensate image data DATA so that the data signal Vdata applied to the pixel PX has a voltage corresponding to a gray level between the first gray and the second gray. A data signal Vdata applied to a pixel PX in the i-th frame Fi may be a fourth voltage V4. The fourth voltage V4 may be a voltage corresponding to any gray between the first gray and the second gray.

A data signal Vdata of the fourth voltage V4 may be applied to the pixel PX during at least one period of frames Fi to Fj−1. When a period of Fi to Fj−1 elapses, image data DATA may be compensated to have a voltage corresponding to the third gray between the fourth gray and the second gray. The data signal Vdata applied to the pixel PX in the j-th frame Fj may be the third voltage. A data signal Vdata of the third voltage V3 may be applied to the pixel PX during at least one frame period of Fj to Fi−1.

As the third gray and fourth gray are grays between the first gray and the second gray, and when the third gray is stored in a LUT, the fourth gray can be calculated through interpolation, and a description of a method of interpolation is omitted as any method known in the art may be used.

Also, a length of a period of Fi to Fj−1 and a length of a period of Fj to Fi−1 may be the same as or different from each other. A length of a period of Fi to Fj−1 and a length of a period of Fj to Fi−1 may be determined in consideration of at least one of the difference between the first gray and the fourth gray, the difference between the fourth gray and the third gray, and the difference between the third gray and the second gray, but is not limited thereto.

When a period of Fj to Fi−1 elapses, a data signal Vdata of the second voltage V2 is applied to the pixel PX from the first frame F1 to the n-th frame Fn.

In FIG. 10, a data signal corresponding to the second gray is compensated by a data signal corresponding to the third gray and a data signal corresponding to the fourth gray, but it may be compensated by data signals corresponding to a plurality of grays, and the number of grays to be compensated is not limited. For example, in FIG. 10, a data signal corresponding to the second gray is compensated by a data signal corresponding to the fifth gray, a data signal corresponding to the fourth gray, and a data signal corresponding to the third gray, and the data signal may be sequentially output from the data driver 120 (the first gray<the fifth gray<the fourth gray<the third gray<the second gray).

Figure 12:
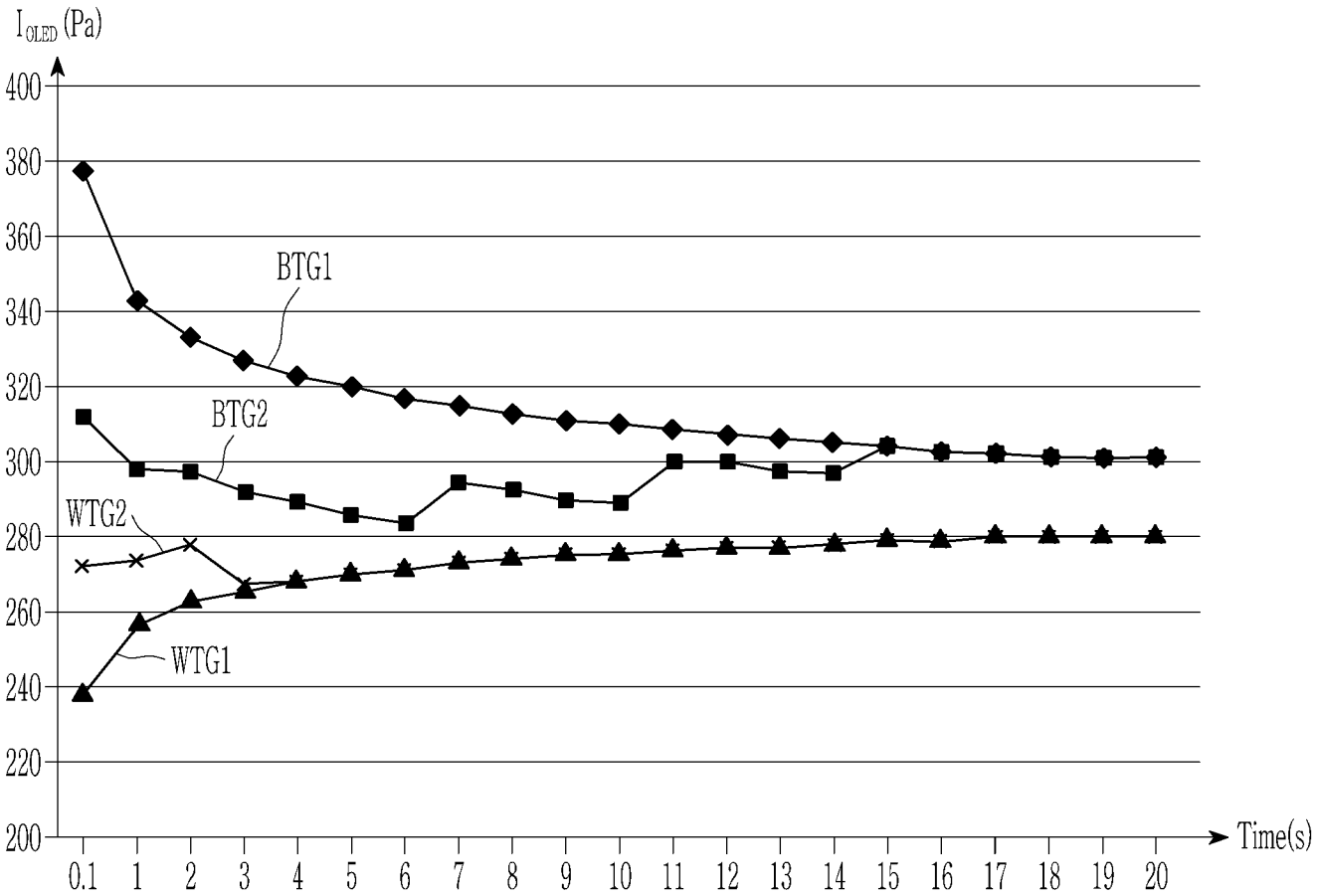

FIG. 11 and FIG. 12 are tables and graphs showing a current flowing through an organic light emitting diode according to a driving method of a display device according to exemplary embodiments.

FIG. 11 (*a*) is a table showing voltage values of a data signal Vdata applied to the pixel PX and values of a driving current $I_{OLED}$ when an image is switched from a 0 gray to a 48 gray, and FIG. 11 (*b*) is a table showing voltage values of a data signal Vdata applied to the pixel PX and values of a driving current $I_{OLED}$ when an image is switched from a 255 gray to a 48 gray.

Referring to FIG. 11 (*a*) and a BTG1 curve of FIG. 12, when the image is switched from the 0 gray to the 48 gray (a target gray), if a value of a data signal Vdata applied to the pixel PX is 5.35 V corresponding to the 48 gray, a value of a driving current IDLED is a very high value such as 377 pA or 343 pA due to a hysteresis phenomenon of a transistor. Therefor, image sticking due to the switched image occurs. After 17 seconds, the value of the driving current IDLED converges to 301 pA (i.e., the value of the target driving current by the data signal Vdata of 5.35 V).

Referring to FIG. 11 (*a*) and a BTG2 curve of FIG. 12, when the image is switched from the 0 gray to the 48 gray, if a value of a data signal Vdata applied to the pixel PX is 5.4 V corresponding to the 43 gray (0.1 seconds) by compensating the image data DATA, a value of a driving current IDLED has a target value such as 312 pA due to the hysteresis phenomenon of a transistor. Then, the data signals Vdata corresponding to the 44 to 47 grays are sequentially applied to the pixel PX, so that a deviation between the driving current $I_{OLED}$ and the target driving current value is reduced. As a result, image sticking due to the switched image can be improved.

Referring to FIG. 11 (*b*) and a WTG1 curve of FIG. 12, when the image is switched from the 255 gray to the 48 gray (a target gray), if a value of a data signal Vdata applied to the pixel PX is 5.35 V corresponding to the 48 gray, a value of a driving current $I_{OLED}$ has a very low value such as 239 pA or 257 pA due to the hysteresis phenomenon of a transistor. Therefor, an image sticking due to the switched image occurs. After 16 seconds, the value of the driving current $I_{OLED}$ converges to 280 pA (i.e., the value of the target driving current by the data signal Vdata of 5.35 V).

Referring to FIG. 11 (*b*) and a WTG2 curve of FIG. 12, when the image is switched from the 255 gray to the 48 gray, if a value of a data signal Vdata applied to the pixel PX is 5.31 V corresponding to the 51 gray (0.1 seconds) by compensating the image data DATA, a value of a driving current IDLED has a target value such as 272 pA due to the hysteresis phenomenon of a transistor. Then, the data signals Vdata corresponding to the 49 gray are sequentially applied to the pixel PX, so that a deviation between the driving current $I_{OLED}$ and the target driving current value is reduced. Accordingly, image sticking due to the switched image can be improved.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device, comprising:

a display panel to display an image;

a signal controller to determine whether an input image signal corresponding to the image is a still image signal, and when the input image signal is a still image signal, to further determine whether image switching from a first still image to a second still image occurs based on a difference between the first and second still images exceeding a reference value, and when the image switching from the first still image to the second still image occurs, to compensate image data corresponding to the second still image according to frame data after the image is switched by using data values of two pieces of frame data between which the image switching occurs; and a data driver to generate a data signal based on the image data corresponding to the second still image and to output the data signal to the display panel.

2. The display device of claim 1, wherein the signal controller includes an image determiner to compare at least two pieces of frame data of the input image signal that are adjacent to each other, to determine whether the input image signal is a still image signal.

3. The display device of claim 2, wherein the image determiner is to receive a panel self-refresh (PSR) control signal to control a PSR mode for displaying a still image with the input image signal, and to determine whether the input image signal is a still image signal based on the PSR control signal.

4. The display device of claim 2, wherein when the image determiner determines that the input image signal is a still image signal, the image determiner is to compare the at least two pieces of frame data of the input image signal that are adjacent to each other, to determine whether the image switching occurs.

5. The display device of claim 4, wherein when the image determiner determines that the image switching occurs, an image compensator of the signal controller is to compare the image data according to the frame data after the image is switched, and the data signal is applied to pixels included in the display panel corresponding to a different gray from a target gray based on the frame data after the image is switched.

6. The display device of claim 5, wherein the image compensator is to compare the image data for a plurality of frame periods after the image is switched.

7. The display device of claim 6, wherein the image compensator is to compare the image data according to the frame data after the image is switched during the plurality of frame periods after the image is switched, so that the data signal applied to the pixels corresponds to a plurality of grays different from a target gray based on the frame data after the image is switched.

8. The display device of claim 7, wherein the image compensator is to set the plurality of grays to be adjacent to the target gray over time after the image is switched.

9. A display device comprising:

a display panel to display an image, the display panel including a pixel including a light emitting element to emit light based upon a driving current corresponding to a data signal being applied to a data line;

a signal controller to generate image data according to an input image signal corresponding to the image; and a data driver to generate the data signal by using the input image signal, wherein voltage values of data signals applied to the pixel corresponding to the same gray are different from each other, based on whether a still image displayed by the input image signal corresponding to the image is switched from a first still image to a second still image based on a difference between the first and second still images exceeding a reference value.

10. The display device of claim 9, wherein the voltage values of the data signals applied to the pixel increase or decrease from a time point when the still image is switched.

11. The display device of claim 10, wherein a period in which the voltage values of the data signals applied to the pixel increase or decrease is within 15 seconds.

12. The display device of claim 9, wherein the pixel further comprises:

a first transistor to conduct driving current according to a voltage difference between a gate and one end of the first transistor;

a capacitor to store a voltage corresponding to the data signal; and a second transistor connected to the data line and to be activated by a corresponding scan signal to receive the data signal.

13. A driving method of a display device to display an image, comprising the steps of:

determining whether an input image signal corresponding to the image is a still image signal;

when the input image signal is a still image signal, further determining whether image switching from a first still image to a second still image occurs based on a difference between the first and second still images exceeding a reference value; and when the image switching from the first still image to the second still image occurs, using data values of two pieces of frame data between which the image is switched to compensate image data corresponding to the second still image according to frame data after the image is switched.

14. The driving method of claim 13, wherein the step of further determining whether the image switching occurs comprises comparing at least two pieces of frame data of the input image signal that are adjacent to each other, to determine whether the input image signal is a still image signal.

15. The driving method of claim 14, wherein the step of further determining whether the image switching occurs further comprises receiving a panel self-refresh (PSR) control signal for controlling a PSR mode to display a still image with the input image signal, and determining whether the input image signal is a still image signal based on the PSR control signal.

16. The driving method of claim 14, wherein the step of further determining whether the image switching occurs further comprises determining that the input image signal is a still image signal, and then comparing at least two adjacent pieces of frame data of the input image signal to each other to determine whether the image switching occurs.

17. The driving method of claim 16, wherein the step of compensating of the image data comprises, when the image switching occurs, compensating the image data according to the frame data after the image switching occurs, and applying a data signal to pixels included in a display panel corresponding to a different gray from a target gray based on the frame data after the image switching occurs.

18. The driving method of claim 17, wherein the step of compensating of the image data further comprises compensating the image data for a plurality of frame periods after the image switching occurs.

19. The driving method of claim 18, wherein the step of compensating the image data for the plurality of frame periods after the image switching occurs further includes compensating the image data according to the frame data after the image switching occurs for the plurality of frame periods after the image switching occurs, and compensating the data signal applied to pixels included in the display panel corresponding to a different gray from a target gray based on the frame data after the image switching occurs.

20. The driving method of claim 19, wherein a plurality of grays may be set to be close in value to the target gray over time after the image switching occurs.

* * * * *